United States Patent [19]

Wünning

[11] 4,003,764

[45] Jan. 18, 1977

[54] PREPARATION OF AN ε-CARBON NITRIDE SURFACE LAYER ON FERROUS METAL PARTS

[75] Inventor: Joachim Wünning, Warmbronn, Germany

[73] Assignee: Firma J. Aichelin, Korntal near Stuttgart, Germany

[22] Filed: May 8, 1974

[21] Appl. No.: 467,913

[30] Foreign Application Priority Data

May 17, 1973 Germany ..... 2324918

[52] U.S. Cl. ..... 148/16.5; 148/16.6

[51] Int. Cl.[2] ..... C23C 11/12; C23C 11/18

[58] Field of Search ..... 148/12.1, 16.5, 16.6, 148/31.5; 266/2, 5

[56] References Cited

UNITED STATES PATENTS

| | | | |
|---|---|---|---|
| 1,995,314 | 3/1935 | Machlet | 148/16.5 |
| 2,472,320 | 6/1949 | Vennerholm et al. | 148/16.5 |
| 3,228,807 | 1/1966 | Mitchell et al. | 148/16.6 X |
| 3,240,636 | 3/1966 | Daubersy | 148/16.5 |
| 3,399,085 | 8/1968 | Knechtel et al. | 148/16.6 |
| 3,519,257 | 7/1970 | Winter et al. | 148/16.5 |
| 3,748,195 | 7/1973 | Kondo et al. | 148/16.6 |

FOREIGN PATENTS OR APPLICATIONS

| | | | |
|---|---|---|---|
| 2,063,287 | 7/1971 | France | 148/16.6 |
| 1,156,180 | 6/1969 | United Kingdom | 148/16.5 |

OTHER PUBLICATIONS

Metal Progress, Nov. 1949, pp. 651–655.

*Primary Examiner*—C. Lovell
*Attorney, Agent, or Firm*—Flynn & Frishauf

[57] ABSTRACT

A gas carbon nitriding method to produce ε-carbon nitride layers on ferrous metal substrates. The gas atmosphere comprises partially dissociated ammonia and contains between about 2 and 20% (by volume) of carbon monoxide and carbon dioxide. The treatment temperature is between 500° and 650° C. The process is characterized in that the average nitriding potential, $p_{NH_3}/p_{H_2}^{1.5}$, is between 0.5 and 5, and the partial pressure ratio, $p_{CO}/p_{CO_2}$, is between about 1 and 10.

The gas atmosphere is formed by introducing into the furnace chamber (a) an ammonia-containing gas, and (b) a combusted gas containing carbon dioxide.

14 Claims, 2 Drawing Figures

PREPARATION OF AN ϵ-CARBON NITRIDE SURFACE LAYER ON FERROUS METAL PARTS

The present invention provides a gas process for preparing a surface layer of ϵ-carbon nitride on ferrous metal parts. The process is carried out at a temperature from 500°–650° in a gaseous atmosphere of partially dissociated ammonia which may be diluted with nitrogen. The gaseous atmosphere also contains a total volume of carbon monoxide and carbon dioxide of between 2 and 20% by volume.

Ferrous metal parts having ϵ-carbon nitride surfaces have good wear resistance and are tough. They are also corrosion resistant. The term "ferrous metal" is used in its dictionary meaning of an iron alloy containing more iron than any other metal.

Methods for producing ϵ-carbon nitride of a thickness of 10 to 15 μm by immersion in salt baths at a temperature of 570° C for about 2 hours are known. This method does not permit variation of the carbon content of the ϵ-carbon nitride layer. It also has the disadvantage that it is difficult to automate the process and the major disadvantage that the cyanide-cyanate salts used are toxic thereby requiring special precautionary measures in the plant and also waste water treatment.

Gaseous processes for producing the ϵ-carbon nitride layer at high temperatures in furnaces are also known. DT-OS No. 1,521,450 discloses such a process in which the carbon nitriding takes place in partially dissociated ammonia which also contains a hydrocarbon or a mixture of hydrocarbons. In a similar process disclosed in DT-OS No. 2,135,760 carbon monoxide and an elementary oxygen-containing gas are added in specific quantities to an atmosphere consisting of a nitrogen-containing gas. An improvement in the nitriding effect of a partially dissociated ammonia-containing atmosphere by the addition of an oxidation agent, for example, water, is disclosed in DT-OS No. 1,521,607.

In the foregoing methods, which are carried out at a temperature of about 570° C, there is an appreciable danger of explosion because the processing temperature is only slightly below the ignition temperature of the hydrocarbons. This involves particular difficulties with furnaces utilizing air locks on the furnace chamber. It is also not possible to vary the carbon content of the ϵ-carbon nitride layer in such processes.

DT-OS No. 2,228,746 discloses a gas method which utilizes a partially dissociated ammonia at a temperature of from 550° to 750° C. Carbon from the core of the ferrous metal part being nitrided diffuses toward the surface to form the ϵ-carbon nitride layer. The nitriding effect is influenced by addition of oxygen or of an oxygen-containing gas, for example, carbon monoxide. This method is limited to iron alloys having high carbon content. It is further limited in that the diffusion of carbon from the interior to the surface is hindered by the slow dissolution of carbide at 570° C.

The present invention provides a method which overcomes many of the disadvantages of the prior methods. It is able to produce ϵ-carbon nitride layers having a desired carbon content. It also utilizes a nonexplosive gaseous atmosphere.

SUBJECT MATTER OF THE INVENTION

The present invention provides a method of producing ϵ-carbon nitride layers on ferrous metal parts in a furnace chamber. The atmosphere is partly dissociated ammonia which may be diluted with nitrogen. The atmosphere also contains between about 2 and 20 volume percent of carbon monoxide and carbon dioxide. The process is carried out at a temperature of between about 500° and 650° C. The process is characterized in that the atmosphere has an average nitriding potential, $p_{NH_3}/p_{H_2}^{1.5}$, of between 0.5 and 5. The partial pressure relationship, $p_{CO}/p_{CO_2}$, is between 1 and 10.

$p_{NH_3}$ is the partial pressure of ammonia in the furnace chamber.

$p_{H_2}$ is the partial pressure of the hydrogen in the furnace chamber.

$p_{CO}$ is the partial pressure of carbon monoxide in the furnace chamber.

$p_{CO_2}$ is the partial pressure of the carbon dioxide in the furnace chamber.

The method is preferably carried out at a temperature of about 570° C which temperature is slightly below that of the formation of nitrogen austenite.

The method of the present invention is economically carried out when utilizing as the gaseous atmosphere in the furnace chamber, a mixture of ammonia and combusted gas, said atmosphere having one of the aforespecified values for the nitriding potential and a partial pressure ratio $p_{CO}/p_{CO_2}$, in a ratio of between 1:0.3 and 1:3. The precisely preferred value within this quantative relation depends on the respective size of the furnace chamber and the loading area. The combusted gas which is preferably used is produced by burning combustible gases containing hydrocarbons with a less than stoichiometric amount of air. The gases are then cooled to room temperature which largely eliminates the water product of the combustion.

By suitable control of the ratio of the combustible gas and air, it is possible to produce a combusted gas containing a total of less than five volume percent of combustible components. A total of less than 5% of combustible components is below the explosion limit. A typical combusted gas used in the present invention has the following volume composition: 2% hydrogen, 2% carbon monoxide, 2% water, 10% carbon dioxide, and the remainder nitrogen.

An especially simple process is achieved when the furnace chamber is heated by the combustion reaction which produces the desired combusted gas which is then used as a component of the furnace atmosphere. The water produced during the combustion reaction which heats the furnace chamber is separated before the reacted combusted gas is introduced as part of the furnace atmosphere. Water separation may be carried out relatively simply by passage of the combusted gas through a water cooler. In this embodiment of the process, it is possible to control the composition of the combusted gas which is fed to the furnace chamber to become a component of the atmosphere thereof, by adjustment of the combustible gas-air mixture in the combustion reaction which results in the heating of the furnace chamber.

The process of the present invention may advantageously be carried out utilizing a finely dispersed iron (which may be positioned on a porous carrier) as a catalyst. This assists the reduction of carbon dioxide to carbon monoxide by the water-gas reaction with the hydrogen which was formed as a result of the dissociation of ammonia so that the desired partial pressure relation, $p_{CO}/p_{CO_2}$, in the atmosphere is obtained. The catalyst does not result in an undesired additional dissociation of the ammonia in the atmosphere.

It has also been found that the nitriding effect is increased if oxidized iron is used as the catalyst. Contrary to expectation, in spite of the presence of the iron catalyst, the parts are cooled to produce a smooth finished product. The effectiveness of the oxidized iron catalyst is decreased during processing as the catalyst is increasingly reduced. Therefore, the iron catalyst is reoxidized by contact with air before the subsequent processing.

The carbon content of the ε-carbon nitride layer may be controlled by adjustment of the hydrogen content of the gaseous atmosphere. The carbon content of the ε-carbon nitrid layer increases approximately in proportion to the hydrogen content of the gaseous atmosphere used in the present invention.

The present method may be used with batch furnaces that do not have air locks. After the metal parts are placed in the furnace chamber and during the heating of chamber to the nitriding temperature, the air in the chamber is flushed out with the combusted gas. After reaching the nitriding temperature, the ammonia is introduced into the furnace chamber. The addition of ammonia is terminated at the beginning of the cooling period which follows the nitriding process. The combusted gas is also preferably fed to the furnace chamber for flushing during the cooling period. After the cooling period is completed, the parts are taken from the furnace chamber. This method of processing is particularly simple and economic because the inexpensive and nonexplosive combusted gas is used as the flushing gas and also as the reaction gas. Although the combusted gas may have a minor oxidizing affect on iron generally, it has been found that the parts when cooled after the aforedescribed processing are shiny.

The process of the present invention may also be utilized with a continuous furnace having one or more air locks protecting the furnace chamber. The atmosphere in the furnace chamber is maintained by addition of the combusted gas and of the nitrogen. The combusted gas is also continuously added to the air locks in an amount adequate for flushing during the processing cycle and is then discharged from the furnace. With this procedure, when the outer air lock door is opened, only nonexplosive combusted gas exits. No ammonia and hydrogen-containing nitriding gas exits so that malodor is avoided. The nitriding gas only exits through the furnace waste gas exit ports and the air locks. With this procedure, during loading and unloading, air cannot enter the furnace chamber and a mixture of air and nitriding gas does not form in the air locks which avoids the danger of an explosive air-hydrogen-gas mixture.

It is advantageous if the combusted gas and the ammonia are added to the furnace chamber through concentric pipes. These two materials may form solid precipitated material at room temperature when they are mixed which results in clogging of the supply ducts. When utilizing concentrically positioned supply ducts, an intimate mixing of the two gases occurs immediately at the discharge end of the supply ducts and does not provide an opportunity for clogging.

The invention will be described by way of examples and with reference to the accompanying drawings.

Figure 1:
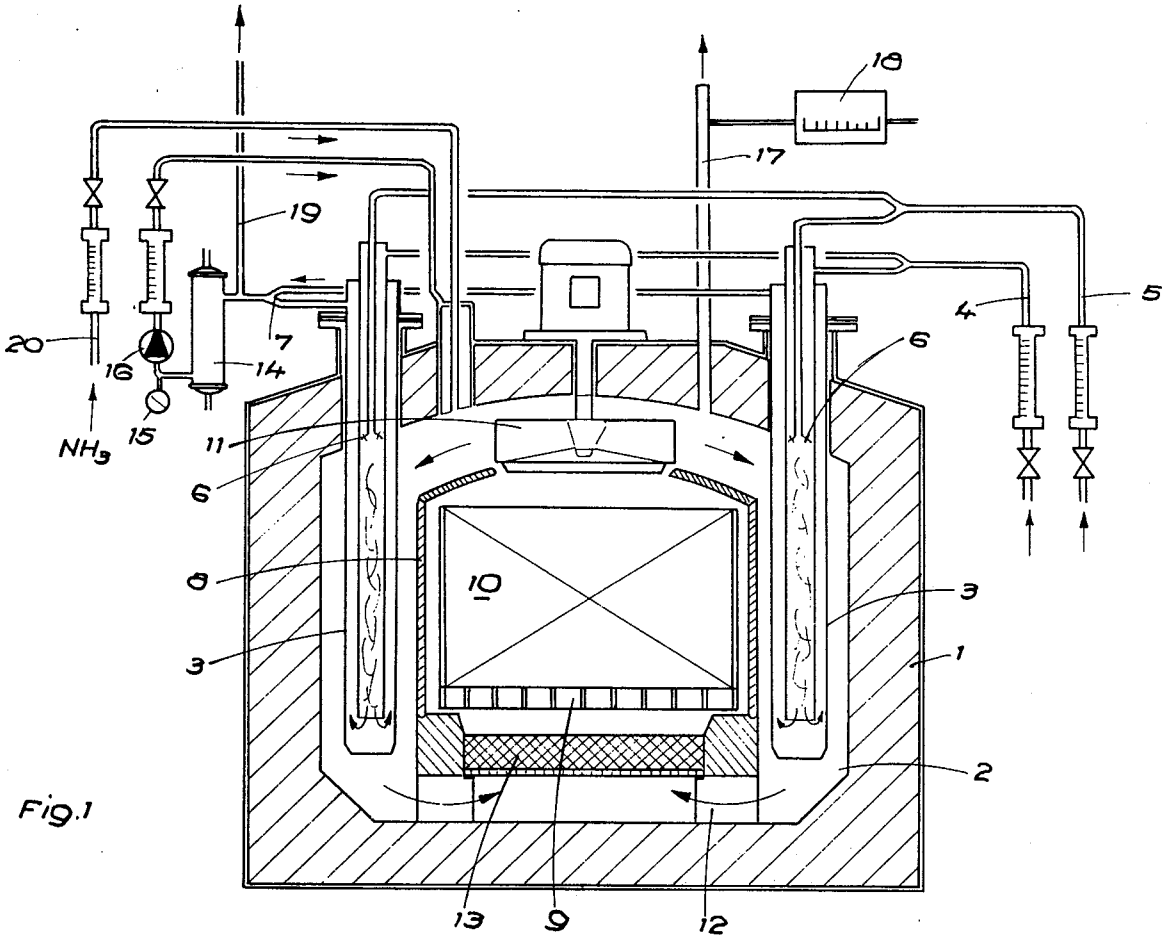
FIG. 1 is a vertical cross section of a batch furnace.

As depicted in FIG. 1, the batch furnace 1 contains a closed furnace combustion chamber 2 which is accessible through doors which are not depicted. Multiple radiation tubes 3, of which two are illustrated, are supplied air and combustion gas through ducts 4 and 5 respectively. The combustion gas-air mixture exits from the duct into the radiation tube 3 through burner nozzle 6 and burns in the radiation heating tube 3. The combusted gases are collected and drawn off through duct 7.

The combustion chamber 2 contains an enclosed muffle which contains a gas permeable grid 9. The charge 10 of ferrous metal parts is positioned on the grid. A motor-driven fan 11 in the combustion chamber 2 produces a flow of gas as indicated by the arrows in FIG. 1. By suitable arrangement within the chamber 2 of the muffle 8 and gas conduits 12, the gas is caused to circulate from below the grid 9 up and surrounding all portions of the charge 10. A catalyst layer 13 is arranged in the chamber 2 below the grid 9. The gaseous atmosphere is circulated by fan 11 through the catalyst layer 13 and then through grid 9 to the charge. The catalyst layer 13 is a solid phase, for example, finely dispersed iron on a porous carrier.

The relative proportion of air and the combustion gas which are supplied through ducts 4 and 5 respectively is adjusted so that the combusted gas which is produced by the combustion in radiant heating tubes 3 consists of about 2% hydrogen, 2% carbon monoxide, 2% water, 10% carbon dioxide, and the remainder, nitrogen. The combusted gas is withdrawn through duct 7 and passed through cooler 14 wherein the water is removed by a water remover 15. All or a portion of the combusted gas may then be pumped to the burning chamber by pump 16. Other portions may be removed through waste gas duct 17. A gas analyzer 18 is connected to the waste gas duct 17 and is used to monitor the waste gas composition.

After the furnace chamber 2 is loaded with charge 10, air in the chamber 2 is flushed therefrom by the combusted gas which is pumped in by pump 16 and at the same time the furnace atmosphere is heated to about 570° C which is the nitriding temperature. The excess combusted gas is vented through the duct 19.

After reaching the nitriding temperature, ammonia is also introduced into the furnace chamber 2 through duct 20 until the desired value of the nitriding potential, $p_{NH_3}/p_{H_2}^{1.5}$, is between 0.5 and 5 and the partial pressure ratio, $p_{CO}/p_{CO_2}$, in the furnace chamber is maintained between 1 and 10. When the nitriding processing period is completed, the addition of ammonia through duct 20 is stopped and the parts are taken from the chamber 2 after they have cooled. If an air lock, not illustrated, is provided on the combustion chamber 2 of FIG. 1, the air lock will be constantly flushed with combusted gas while the nitriding atmosphere is present in the muffle during the nitriding process.

In place of or in addition to the combusted gas which is introduced into the chamber 2, carbon dioxide with or without nitrogen may be introduced. The carbon dioxide may be supplied from conventional storage tanks. This is often necessary if the heating chamber is brought to the nitriding processing temperature by another means than combustion of combustible gases and air to form combusted gas.

Figure 2:
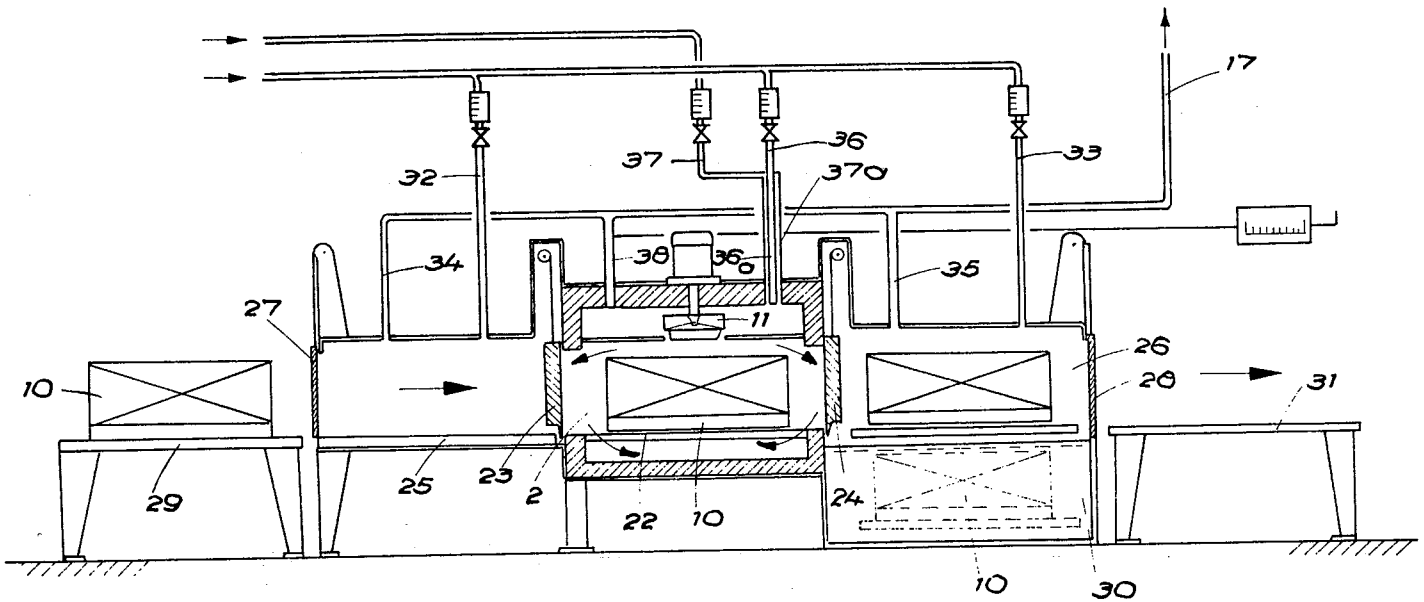
FIG. 2 is a vertical cross section and schematic illustration of a continuous furnace and associated equipment including air locks.

FIG. 2 which depicts the process and continuous furnace utilizes the same reference numerals for corresponding parts as in the batch furnace depicted in FIG. 1. The furnace chamber 2 contains the load 10 which is positioned on suitable transport means, for example, a gas permeable roller track 22. The chamber 2 is closed by doors 23 and 24 respectively. Rotating fan 11 circulates the gaseous atmosphere as indicated by the arrows to assure that the parts comprising the charge or load 10 are intimately contacted and surrounded by the gaseous atmosphere. In a manner similar to the batch furnace depicted in FIG. 1, an iron or iron oxide catalyst layer may be provided below the charge 10. The circulating gas is circulated through the catalyst and then through the charge.

Air locks 25 and 26 are positioned on opposed sides of chamber 2. Air lock 25 is closed by door 27 and air lock 26 is closed by door 28.

The loading of the furnace chamber 2 is carried out in a sequential fashion. A new load 10 is charged utilizing a loading installation depicted schematically at 29. The sequence is such that when door 27 is opened, the furnace door 23 is closed. This is assured through interconnecting the two door. After the nitriding treatment has been completed, the charge 10 in the chamber 2 is moved through open door 24 into air lock 26 and then after door 24 is closed, door 23 is opened and a new charge 10 waiting in the front air lock 25 is moved into the furnace chamber 2. The discharge air lock 26 has a quenching bath 30. The charge is selectively quenched or cooled in the air lock utilizing gas. The quenched or cooled charge 10 is then moved through open door 28 to a discharge installation schematically depicted at 31.

Although the charge 10 is depicted schematically as a single load, larger furnace chambers may contain several distinct charges.

The operation of the furnace depicted in FIG. 2 follows. Air lock doors 27 and 28 are both opened. A new load is charged into the inlet airlock 25 and a treated load is withdrawn from the cooling air lock 26, while doors 23 and 24 are closed. After the respective inlet of the new charge and discharge of the old charge, the doors 27 and 28 are closed. The air locks 25 and 26 are then flushed with combusted gas, obtained from a gas source which is not illustrated; said combusted gas being introduced through ducts 32 and 33. Gas is vented from air locks 25 and 26 through exhaust gas ducts 34 and 35 respectively which in turn flow into an exhaust (waste) gas collection duct 17. The combusted gas is continuously supplied to air locks 25 and 26 by ducts 32 and 33 respectively to maintain a continuous flushing action. After the charge in the chamber 2 has been completely processed, doors 23 and 24 are opened and the process charge withdrawn through door 24 and the new charge enters through door 23 and the said doors are then again closed. During nitriding in the chamber 2, a gas atmosphere is maintained having an average nitriding potential, $p_{NH_3}/p_{H_2}^{1.5}$, of between 0.5 and 5, and a partial pressure relationship, $p_{CO}/p_{CO_2}$, of between 1 and 10. To maintain this atmosphere, combusted gas of the desired composition and in an adequate amount is supplied through duct 36. At the same time ammonia is continuously supplied through duct 37. Ducts 36 and 37 are concentric at the point at which the respective gases exit therefrom into the chamber 2 so that the ammonia and the combusted gas only contact each other when entering chamber 2. The chamber 2 is also connected to the waste gas collection duct 17 through duct 38 so that a constant pressure relationship exists. The temperature during processing in chamber 2 is preferably maintained at about 570° C. The heating of the chamber 2 is not depicted in detail in FIG. 2. It may be carried out in any desired fashion by conventional means or other means including radiant heating tubes or electric heating elements. When using radiant heating tubes heated by combustion of air and combustion gases, the product combusted gas may be obtained and used as the source of the carbon components of the nitriding gas atmosphere by proper control of the reactions as discussed hereinbefore in connection with the operation of the batch furnace of FIG. 1.

The process for producing the ε-carbon nitride layer of the present invention is further illustrated in the following examples. All percentages in the specification and claims are by volume, unless specified otherwise.

EXAMPLE 1

Steel parts containing 0.1% carbon and having a thickness of 60 μm were treated at a temperature of 570° C and at a pressure of 1.05 atmospheres for 2 hours. The gas atmosphere contained 40% ammonia, 35% hydrogen, 5% water, 5% carbon monoxide, 2% carbon dioxide, and 13% nitrogen. The relationship, $p_{NH_3}/p_{H_2}^{1.5}$, equalled 1.9; and the relationship, $p_{CO}/p_{CO_2}$, equalled 2.5.

After treatment the parts had a uniform and dense ε-carbon nitride surface layer of a thickness of 14 μm. The average carbon content of the iron parts had risen to 0.7%. Since the carbon only dissolves in the ε-carbon nitride layer and not in the core of the parts which consists of α-iron, the carbon content of the ε-carbon nitride layer therefore was considerably higher.

EXAMPLE 2

An air lock furnace of the type depicted in FIG. 2 is utilized. Ammonia and combusted gas in a ratio of 1:1 were introduced into the furnace chamber which was at a temperature of 570° C. At the same time the combusted gas was added to the air locks. The combusted gas contained 2% carbon monoxide, 2% water, 10% carbon dioxide, and the remainder was nitrogen.

The load consisted of parts comprising unalloyed iron of a carbon content of less than 0.1%.

In the processing chamber, the gaseous atmosphere was circulated over an iron catalyst and through the charge. The atmosphere contained 25% ammonia, 23% hydrogen, 3.5% carbon monoxide, 3.5% carbon dioxide, 1.5% carbon dioxide, 43.5% nitrogen.

The relationship, $p_{NH_3}/p_{H_2}^{1.5}$, was 2.3; and the partial pressure relationship, $p_{CO}/p_{CO_2}$, was 2.3.

After 2 hours of treatment, the surface of the parts in the load were uniformly coated with a dense ε-carbon nitride layer having a thickness of 18 μm. The untreated parts had an initial thickness of 60 μm. The carbon contents of the parts had risen from an average of less than 0.1% to about 0.4%. The percentages of carbon in the examples are percentages by weight in contrast to the percentages of the gas components which are by volume.

The examples establish that the process of the present invention provides an excellent nitriding effect and also concomitantly provides carburization of the ε-nitride layer. This is achieved without the addition of hydrocarbons or explosive gases to the nitriding atmosphere. In the preferred embodiment using the combusted gases, it permits using the direct reaction gases from heating the furnace chamber with at most removal of water. Other cleaning processes for the combusted gases are not required.

The nitriding potential contains the values of the partial pressures of the ammonia and of the hydrogen in a gaseous atmosphere. The degree of dissociation of the ammonia, i.e., the ratio of not dissociated ammonia to the ammonia dissociated into hydrogen and nitrogen can be calculated from the ratio of the partial pressures by formulas which are well known in the art. The degree of dissociation is dependent on the temperature of the gaseous atmosphere, and the parts by volume of ammonia, nitrogen and hydrogen depend also on the amount of ammonia introduced into the gaseous atmosphere.

In order to forestall danger of explosion, it is an important feature of the present invention that the sum of the combustible components of the combusted gas as introduced into the nitriding furnace totals less than 5% by volume.

According to the invention the air in the furnace chamber is flushed out with the combusted gas at the beginning of the nitriding process. At the end of the process the nitriding atmosphere in the chamber is also flushed out with the combusted gas. In this way it is excluded that oxygen of the air and combustible gases become mixed in the furnace chamber at any time. In contrast hereto known nitriding processes require an intermediate flushing with an inert gas, what is more complicated and more expensive. The nitriding gases which are fed into the furnace have of course a different composition as compared with the atmosphere in the furnace, because at the temperatures at which the nitriding process is carried out chemical reactions between the gaseous components take place which may also be influenced by catalysts which are present. In the furnace itself a gaseous atmosphere may develop which contains more than 5% of combustible components. This atmosphere however, never is present simultaneously with oxygen in the furnace chamber.

What is claimed:

1. The carbon nitriding process of producing an $\epsilon$-carbon nitride layer on the surface of ferrous metal articles in a gaseous atmosphere contained in a furnace chamber, comprising contacting at a temperature between 500° and 650° C said ferrous metal articles with said gaseous atmosphere, said gaseous atmosphere comprising (i) partially dissociated ammonia, and (ii) carbon monoxide and carbon dioxide in a total of between 2 and 20 volume %, and maintaining said gaseous atmosphere during the nitriding process to have an average nitriding potential, $p_{NH_3}/p_{H_2}^{1.5}$, of between 0.5 and 5, and a partial pressure relationship, $p_{CO}/p_{CO_2}$, of between 1 and 10; wherein, $p_{NH_3}$ is the partial pressure of ammonia in the furnace chamber;

$p_{H_2}$ is the partial pressure of the hydrogen in the furnace chamber;

$p_{CO}$ is the partial pressure of carbon monoxide in the furnace chamber;

$p_{CO_2}$ is the partial pressure of the carbon dioxide in the furnace chamber said gaseous atmosphere having been formed by introducing (a) an ammonia-containing gas, and (b) a combusted gas which is a mixture of carbon monoxide, carbon dioxide and nitrogen, into said furnace chamber, said ammonia-containing gas (a) being in a ratio to said combusted gas (b) of between 1:0.3 and 1:3.

2. The process of claim 1, wherein said temperature is about 570° C.

3. The process of claim 1, wherein said temperature is about 570° C.

4. The process of claim 3, wherein the sum of the combustible components of the combusted gas totals less than 5% by volume.

5. The process of claim 4, wherein (i) said furnace chamber is heated by the heat from the combustion of combustion gas and air, and said combustion of the combustion gas with air is regulated to produce a combusted gas, (ii) then removing at least some of the water from the combusted gas and (iii) then introducing the combusted gas from which water has been removed into said furnace chamber to become a portion of the gaseous atmosphere thereof.

6. The process of claim 1, wherein said ammonia-containing gas (a) comprises ammonia diluted with nitrogen.

7. The process of claim 1, wherein said furnace chamber contains a finely dispersed iron catalyst which is preferably positioned on a porous carrier.

8. The process of claim 1, wherein said furnace chamber contains a finely dispersed oxidized iron catalyst.

9. The process of claim 8, wherein the oxidized iron catalyst is reduced during the nitriding process and after completion of the nitriding process is oxidized with contact with air.

10. The process of claim 1, wherein the carbon content of the $\epsilon$-carbon nitride layer is increased by increasing the hydrogen content of the nitriding gaseous atmosphere.

11. The process of claim 3, wherein said furnace chamber is a batch furnace which is not protected by air locks, characterized in that after the parts are introduced into the furnace chamber, the air in the furnace chamber is flushed with combusted gas and said combusted gas flushing continues as the charge is heated, when the nitriding temperature of 500°–650° C is reached, ammonia is also introduced into the furnace chamber to form said gaseous atmosphere; and after the completion of the nitriding, the addition of ammonia is stopped and combusted gas is continuously fed to flush the furnace until the furnace has cooled and the parts have been removed.

12. The process of claim 3, wherein said furnace chamber is a part of a continuous furnace apparatus having at least one air lock protecting the furnace chamber, characterized in that the atmosphere in the furnace chamber is constantly maintained as said gaseous atmosphere by addition of combusted gas and ammonia; and that combusted gas is constantly supplied to the one or more air locks to flush the same.

13. The process of claim 3, wherein the combusted gas and the ammonia are brought into the furnace chamber through respective ducts which are positioned concentrically at the point where the said gases are discharged into the furnace chamber.

14. The process of claim 4 wherein said combusted gas also contains at least one gas selected from the group consisting of hydrogen and water vapor.

* * * * *

UNITED STATES PATENT OFFICE

CERTIFICATE OF CORRECTION

Patent No. 4,003,764 Dated January 18, 1977

Inventor(s) JOACHIM WÜNNING

It is certified that error appears in the above-identified patent and that said Letters Patent are hereby corrected as shown below:

Column 8, line 5, replace "claim 1" with --claim 5--.

Signed and Sealed this

Fourth Day of October 1977

[SEAL]

*Attest:*

RUTH C. MASON
*Attesting Officer*

LUTRELLE F. PARKER
*Acting Commissioner of Patents and Trademarks*